US005139080A

United States Patent [19]

Bolton et al.

[11] Patent Number: 5,139,080

[45] Date of Patent: Aug. 18, 1992

[54] MOUNTING ASSEMBLY FOR AN AUTOMOTIVE CONDENSER

[75] Inventors: James D. Bolton, Lancaster; Robert C. Gmerek, Wilson, both of N.Y.

[73] Assignee: General Motors Corporation, Detroit, Mich.

[21] Appl. No.: 807,332

[22] Filed: Dec. 16, 1991

[51] Int. Cl.[5] ..... F28F 9/00; B60K 11/04

[52] U.S. Cl. ..... 165/67; 165/149; 180/68.4; 248/213.3; 248/225.1

[58] Field of Search ..... 165/67, 149; 180/68.4; 248/213.3, 213.4, 224.4, 225.1, 659, 675, 300

[56] References Cited

U.S. PATENT DOCUMENTS

| | | | |
|---|---|---|---|
| 4,306,615 | 12/1981 | Bolton et al. | 165/67 |
| 4,351,505 | 9/1982 | Wickersham | 248/316 |
| 4,531,574 | 7/1985 | Hoch | 165/67 |
| 4,538,697 | 9/1985 | Muroi et al. | 180/68.4 |
| 4,979,584 | 12/1990 | Charles | 180/68.4 |
| 5,067,574 | 11/1991 | Attinger et al. | 180/68.4 |

FOREIGN PATENT DOCUMENTS

| | | | |
|---|---|---|---|
| 2304883 | 8/1974 | Fed. Rep. of Germany | 165/67 |
| 2148097 | 5/1985 | United Kingdom | 165/67 |

*Primary Examiner*—John Rivell
*Assistant Examiner*—L. R. Leo
*Attorney, Agent, or Firm*—Ronald L. Phillips

[57] ABSTRACT

An assembly for mounting an automotive condenser to a radiator includes a lower boss having a pair of resilient compression fingers integrally molded on each of the radiator end tanks. An upper boss is also provided. A strip bracket is vertically mounted to the condenser end tanks to mate with the bosses. A mounting blade is defined by a depending wing hook on the bracket mating snugly within the grip of the compression fingers of the lower boss to form an adjustable slip mount. The depending hook projects out and extends downwardly at substantially 90° to captively engage the outer edges of the compression fingers, thus firmly securing the lower portion of the condenser to the radiator. A screw fastener is inserted through a wing tab mating with the upper boss and secured to a J-nut that is clipped to a support plate of the upper boss to complete the assembly.

3 Claims, 3 Drawing Sheets

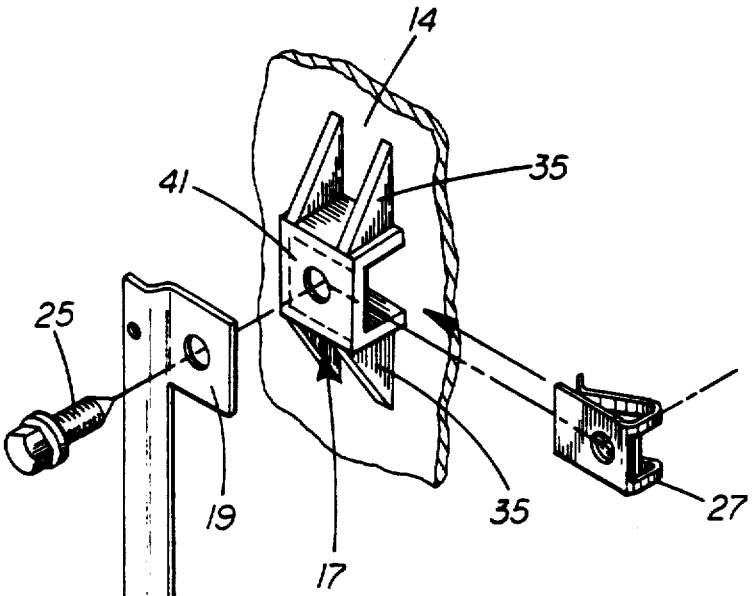
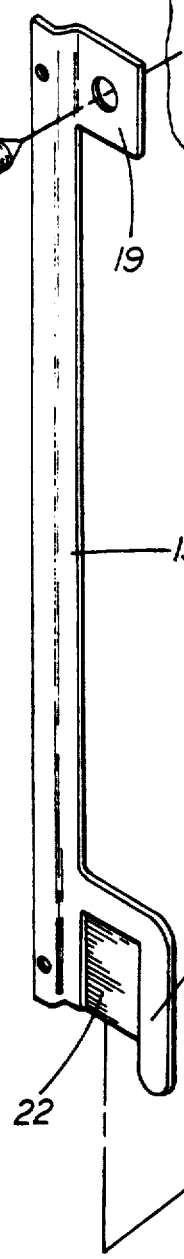
Fig. 1a
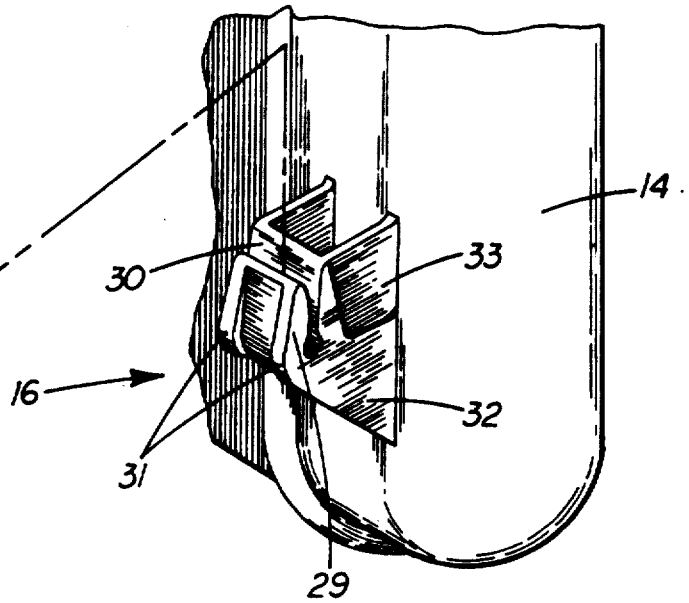

MOUNTING ASSEMBLY FOR AN AUTOMOTIVE CONDENSER

TECHNICAL FIELD

This invention relates to mounting arrangements for vehicle air conditioning system components, and more particularly, to an assembly designed for mounting a condenser of such a system to the radiator of the vehicle.

BACKGROUND OF THE INVENTION

A typical prior art assembly for mounting a condenser to the vehicle radiator includes a pair of vertically extending strip brackets, one bracket extending along each end of the condenser between the radiator end tanks and condenser end tanks. Each bracket includes upper and lower mounting holes through which fasteners, such as screws, are inserted to attach the bracket to the condenser. Wing tabs are located near the upper and lower edges of the brackets. These tabs are fastened to corresponding bosses located on the radiator end tanks, thus securing the condenser to the radiator.

On the assembly line, the actual installation process for the condenser is achieved by first fastening the bracket to the end tanks of the condenser. Then the condenser, with the attached strip brackets, is positioned upright and adjacent to the radiator in a manner such that holes extending through the wing tabs at the upper and lower corners of the condenser align with receiving holes in the radiator bosses. Fasteners are then loosely inserted into the two upper corner fastening locations, whereby the condenser is initially retained in its appropriate position in juxtaposition to the radiator. Installation of the condenser is completed by inserting and tightening the remaining two lower corner fasteners; and then tightening the two upper corner fasteners.

While this assembly has provided an adequate condenser mounting in the past, there is a distinct disadvantage. That is, this arrangement requires fasteners through the wing tabs at both the upper and lower mounting corners. Because of this requirement, an excessive amount of time is required in the installation process, due to the tedious alignment and positioning of the condenser. There is also extra time required to insert, and loosely secure the upper corner fasteners; then insert and tighten the lower corner fasteners and later tighten the upper corner fasteners. Usually two people are required to carry out this procedure of positioning and securing the condenser.

An additional disadvantage to this prior art assembly is the restrictive limitations of the component parts. The prior art assembly provides no significant means of adjustment to accommodate for relatively large dimensional variations. This is of particular concern as any variations in the fabrication of the individual component parts can be cumulative. If the resulting disparity in the fabrication is of such an extent that the mounting holes of the strip brackets can not be aligned with the receiving holes of the radiator bosses, then either the bracket or radiator must be matched with other system components or reworked.

SUMMARY OF THE INVENTION

It is accordingly a primary object of the present invention to provide an assembly of relatively simple construction yielding a more efficient mounting arrangement for an automotive condenser to the radiator.

Another object is to provide such a mounting assembly requiring fewer fasteners so as to simplify the process for securing a condenser to a radiator of a vehicle, and thereby reducing the installation time.

Another object of the present invention is to provide a mounting assembly for a condenser that allows a single assembly line worker to easily handle and secure the condenser on the radiator.

Still another object of the present invention is to provide a more reliable mounting assembly for an automotive condenser, and an arrangement capable of providing a long, trouble-free service life.

Yet another object of the present invention is to provide an apparatus for mounting an automotive condenser accommodating an increased range of adjustability, thereby increasing the allowable manufacturing tolerance in the fabrication of the component parts.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, the assembly of the present invention is adapted to the efficient installation of a condenser of an air conditioning system to a vehicle radiator. The apparatus includes a unique attachment means comprising a boss with a plurality of resilient compression fingers attached to a first portion of a radiator tank. The fingers receive a corresponding mounting blade of a bracket that is fixed to the end tank of the condenser to form an adjustable slip mount. The apparatus also includes a fastening means for securing the condenser through the bracket to another boss on a second portion of the radiator. In combination, the slip mount and the fastening means allow the condenser to be easily positioned and secured.

In particular, the condenser is mounted to the radiator by inserting the condenser, with the bracket attached, so that the mounting blade is received and snugged into position by the resilient compression fingers, thereby securely attaching the condenser to the boss on the first portion of the radiator. The mounting is then completed by securing the fastening means to the boss on the second portion of the radiator tank.

The mounting bracket preferably takes the form of an elongated strip bracket; one strip bracket being carried on each end tank of the condenser. The strip bracket includes a wing hook located near the bottom. Each wing hook projects outwardly (horizontally) from the tank and downwardly (vertically) so as to depend at a substantially 90° angle. This L-shaped hook profile defines the mounting blade in the from of a cross-web that mates within the grip of the compression fingers. Further, the downwardly extending leg of each depending hook engages the outer edge of the cooperating compression fingers. The combined cooperation of this engagement between the blade, the fingers and the opposed hooks forms the slip mount that prevents outward, as well as relative side-to-side movement between the condenser and the radiator, but allows vertical sliding movement for adjustment.

Preferably, the compression fingers are integrally molded into the lower portion of plastic radiator end tanks to form a boss. Each set of fingers includes a shorter front finger and a longer rear finger such that the top of the rear finger extends above the top of the front finger. The differential in finger height helps in locating and leading the bracket into the fingers during the installation procedure. Further, the slot defined between the compression fingers tapers inwardly from the top of the fingers, thereby facilitating insertion of the mounting blade of the bracket between the fingers.

The fastening means at the upper portion of the condenser tank preferably cooperates with the other integrally molded boss on the radiator end tank. It can be a conventional arrangement of a J-nut snapped on the support plate of the boss, an overlying wing tab on the strip bracket, and a screw passing through the wing tab and support plate and into the J-nut.

It can be appreciated that the present invention provides a much more cost-effective design than the prior approach. Not only is the number of support points requiring a fastener, such as a screw, reduced by at least one-half, but the installation procedure itself is greatly simplified. As previously described, the old approach required two people and at least four screw fasteners for installation. The present invention can be readily installed by one person. Since the condenser is a relatively lightweight component, one person can maneuver it into position and insert the hooks into engagement with the compression fingers of the lower boss for support. Together, the resilient fingers and hooks serve to align and snug the condenser for final securing with the fastening means, including the screw fasteners located at the upper portion of the radiator. The snugging and aligning function of the resilient fingers and the depending hooks assure that proper alignment is readily maintained at all times for quicker, easier installation and with a minimal effort of the installer. Accordingly, installer fatigue is reduced, resulting in not only an improved working environment but also a more reliable condenser mounting.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principals of the invention. In the drawing:

FIG. 1*a* is an exploded view showing the separate strip bracket, the upper and lower bosses of the radiator end tank (broken away for clarity), the wing tab, the J-nut and the fastening bolt and the wing hook;

Reference will now be made in detail to the present preferred embodiment of the invention, an example of which is illustrated in the accompanying drawings.

DETAILED DESCRIPTION OF THE INVENTION

Figure 1:
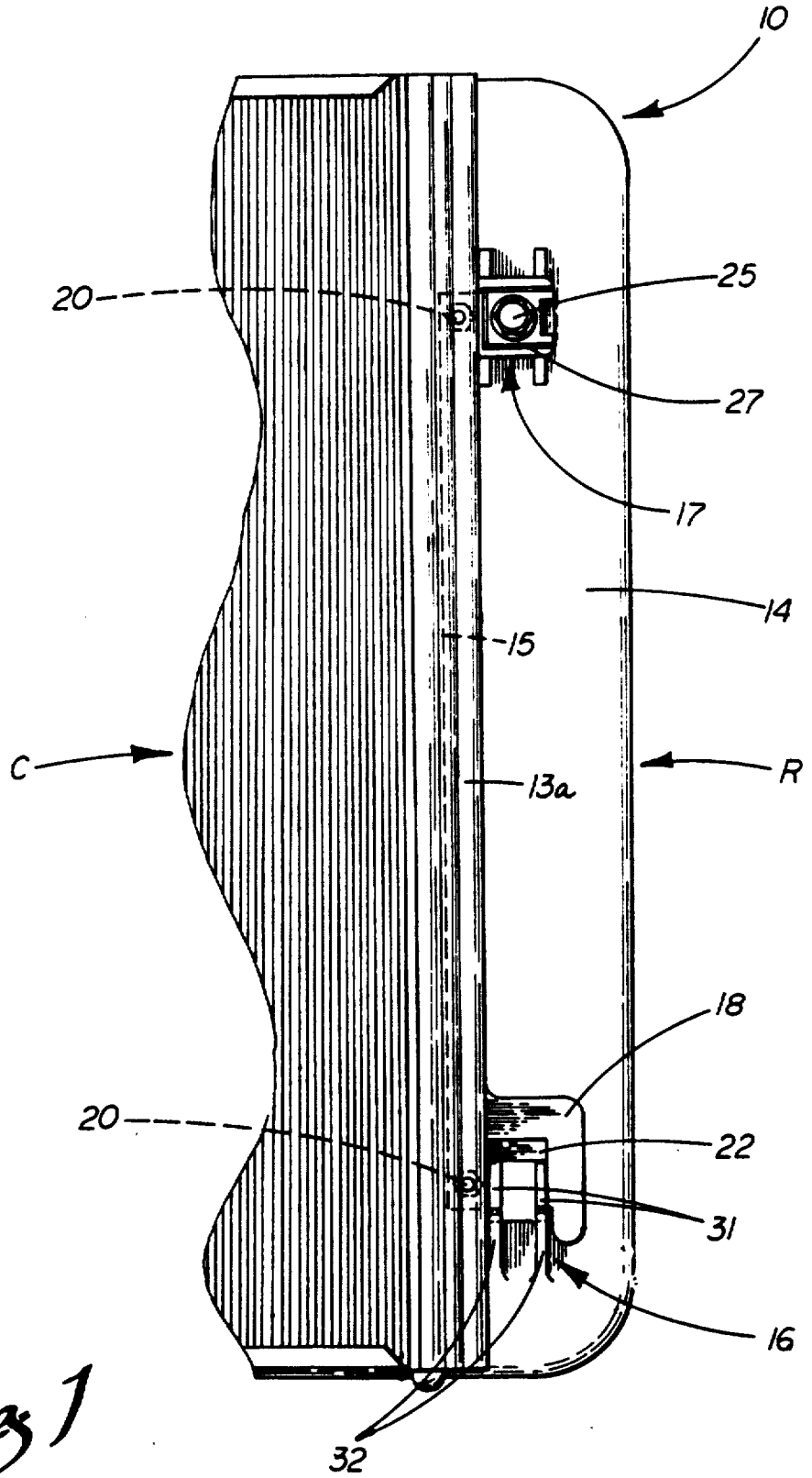
FIG. 1 is a cut-away front view of the mounting assembly of the invention showing one radiator end tank, the lower integrally molded boss with the compression fingers, the corresponding hook on the mating strip bracket, and the upper integrally molded boss and fastening means.
Figure 2:
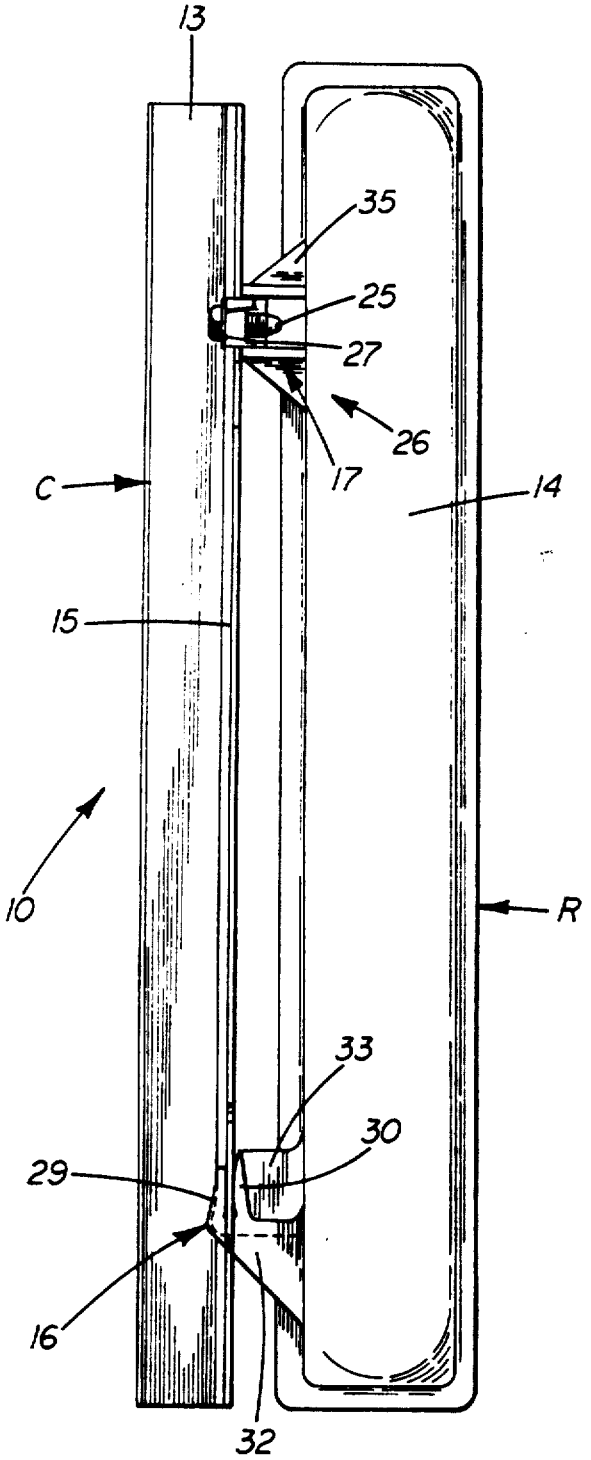
FIG. 2 is a side elevational view of the radiator mounting assembly illustrating more detail of the structure at both the lower and upper support bosses.
Figure 3:
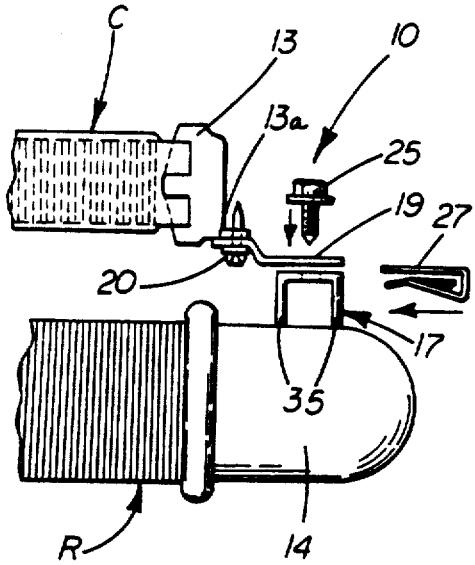
FIG. 3 is a cut-away and exploded top plan view showing additional detail of the relative positioning between the radiator end tank, the condenser end tank and the fastening means at the upper support boss.

Reference is now made to FIGS. 1–3 showing the relative positioning of a mounting assembly 10 for attaching an automotive condenser C to the radiator R. The assembly 10 is positioned between the condenser end tanks 13 and the radiator end tanks 14; one assembly being provided at each end of the condenser C and the radiator R. For purposes of drawing space economy, the drawing figures show the mounting at only one end. It should be recognized that a substantially identical, mirror-image mounting assembly is provided at the opposite end.

The basic mounting assembly 10 includes a strip mounting bracket 15 adapted to be attached to the condenser end tank 13 and two integral bosses molded into the plastic end tank 14; a first boss 16 having compression fingers adjacent a first portion of the end tank and a second boss 17 for receiving a conventional fastening means adjacent a second portion. In the preferred embodiment, the first and second radiator portions correspond respectively to the lower and upper radiator portions and bosses 16, 17 (see FIGS. 1 and 2). The plastic end tank 14 of the radiator R is preferably a high strength, high temperature resistant plastic material capable of being efficiently molded in the general shape shown and with the integral bosses 16, 17, such as high density polyethylene.

The strip bracket 15 includes a depending wing hook 18 adjacent the first or lower portion of the end tank 14, and a wing tab 19 adjacent the second or upper portion (only one strip bracket being shown; see FIG. 1*a*). The bracket 15 receives a plurality of (eg. two) mounting fasteners, namely self tapping screws 20, extending into receiving holes provided in a vertical flange **13*a* extending from the condenser end tank 13 (see FIG. 1**). However, it should be appreciated in accordance with the broader aspects of the present invention, other similar fastening means known in the art could also be employed here as well.

Each wing hook 18 projects outwardly from the bracket 15 then downwardly so as to depend at a substantially 90° angle and thus be substantially L-shaped. A blade 22 formed as a cross-web fills the region defined by the hook 18. This blade 22, which may be a reduced section, mates within the grip of the lower boss so as to form the slip mount for adjustment, as will be discussed below in detail.

The boss 16 is integrally molded into the lower portion of the plastic radiator end tank 14 at each side of the radiator R (only one shown in the figures for clarity). By molding the first boss 16 into the radiator end tanks 14 instead of attaching it with conventional fasteners, a stronger and more reliable mount is achieved.

The first boss 16 includes a pair of vertically extending resilient compression FIGS. 29, 30 extending outwardly from the end tank 14 on integral base 32. A pair of reinforcing gussets 33 occupy the region defined between the rear compression finger 30 and the radiator end tank 14.

The fingers 29, 30 extend upwardly to receive the mounting blade 22 provided on the strip bracket 15. The front finger 29 is shorter than the rear finger 30 (see FIGS. 1*a* and 2). This differential finger height advantageously simplifies the installation procedure by facilitating the insertion of the mounting blade 22 between the fingers 29, 30. Further, the receiving slot defined between the inner surfaces of the fingers 29, 30 tapers inwardly or converges from the top to a midpoint. At this narrowest point of the slot the thickness of the mating mounting blade 22 is greater than the defined space of the slot. This ensures a secure, positive compression slip mount, whereby the bottom of the condenser C is held firmly in place alongside the bottom of the radiator R.

The finger separation at the top of the fingers 29, 30, is substantially greater than the thickness of the received mounting blade 22. This also, like the differential finger height, ameliorates the insertion of the mounting blade 22 between the compression fingers 29, 30, by allowing the installer to easily guide the mounting blade 22 into the receiving slot. Then all that is required is a simple downward force in order to snug the blade 22 between the fingers 29, 30. Further, the front finger 29 may contain a pair of vertically extending reinforcing ribs 31. The ribs 31 are located near the outer edges of the front finger 29 and provide improved gripping strength.

The second or upper boss 17 receives and anchors the wing tab 19 on the strip bracket 15, in the same manner as disclosed in the prior art. The second boss 17 is reinforced by integral gussets 35. An integrally formed support plate 41 provides a raised flat surface for seating of the wing tab 19.

The fastening means for actually securing the wing tab 19 to the boss 17 includes a screw fastener 25, and a cooperating J-nut 27. The J-nut 27 is inserted, from the open side of the second boss 17. The J-nut 27 securely clips onto the support plate 41, whereby the J-nut 27 remains snugly in place while the strip bracket 15 is positioned and the screw fastener 25 is inserted.

Installation of the apparatus in the above-described preferred embodiment is achieved by, first, attaching the strip brackets 15 to each of the condenser end tank 13. Then, the condenser C is lowered into position adjacent to the radiator R, by inserting the mounting blades 22 of the depending wing hooks 18 at each end of the condenser C into the corresponding first bosses 16. It should be appreciated that, due to the relative resilient engagement of the front fingers 29 and the mating blades 22, along with the differential height and taper of the fingers 29, 30, the condenser C does not have to be lowered and held in position with the same precision as previously required. Rather, the top of the condenser C can be tilted away from the radiator R during this time such that visual spotting can be easily made to align the mounting blades 22 with the bosses 16. This is accomplished by a single worker and represents a significant improvement over the prior assembly installation procedure.

Once the mounting blades 22 are inserted between the compression fingers 29, 30 and slipped into position, the depending wing hooks 18 captively engage the outer or side edges of the bosses 16 (see FIG. 1). Thus, this opposing retention force cooperates to prevent relative side-to-side motion of the condenser C. The lower portion of the condenser C is now advantageously securely mounted to the radiator R by a slip mount without the need of inserting and tightening any additional separate fastener.

The final step in the mounting procedure is to adjust the vertical position of the condenser C by upward movement allowed by the lower slip mount, and then secure the upper portion of the strip brackets 15 to the radiator R. As previously discussed, the upper bosses 17 receive and seat the wing tabs 19 of the strip brackets 15. The screw fastener 25 is then inserted through the mating holes in the wing tab 19 and the support plate 41 and tightened in the J-nut 27 (see FIGS. 1*a* and 3).

preferably, the lower and upper bosses 16, 17 are spaced apart such that the mounting blades 22 of the slip mount are not intended to completely seat within the slot between the compression fingers 29, 30. In this manner, it is possible to allow for the vertical adjustment and thereby accommodate greater component manufacturing tolerances while still assuring a secure mounting arrangement. That is, as the wing tabs 19 are being aligned with the upper bosses 17, the condenser C can be adjusted as required. Once this alignment is achieved, each screw fastener 25 is inserted and tightened completing the installation process.

In summary, numerous benefits result from employing the concepts of the present invention. The mounting assembly has relatively few parts and is comparably inexpensive to manufacture, while at the same time simplifying the installation process of the condenser C to the vehicle radiator R. The ease of adjusting and aligning of the components is particularly improved by incorporating the compression fingers 29, 30 and the wing hook 18 to form the adjustable slip mount. Further, only two screw fasteners 25 are required in the combination to then secure the condenser C, rather than the four required in prior art installations. Hence, labor installation costs are also significantly reduced. Additionally, the assembly 10 provides a high quality mounting of utmost integrity, capable of providing a long, problem-free service life.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An assembly for securing a condenser to a mounting means adjacent a radiator in a vehicle, comprising:

a first boss including fingers forming a receiving slot and secured to a first portion of said mounting means;

a second boss secured to a second portion of said mounting means;

bracket means attached to said condenser and mating with said bosses;

said bracket means mating in sliding engagement in said slot between said fingers to form a slip mount to allow vertical adjustment;

fastening means for securing said bracket to said second boss of said mounting means;

whereby said condenser is easily positioned and secured by the combination of said slip mount and said fastening means.

2. An assembly for securing a condenser to end tanks of a radiator in a vehicle, comprising:

a first boss including fingers forming a receiving slot and secured to a first portion of each end tank;

a second boss secured to a second portion of each end tank;

an elongated strip bracket attached to said condenser including a wing hook and a wing tab for mating with said first and second bosses, respectively;

said wing hook including a blade mating in sliding engagement in said slot between said fingers to form a slip mount to allow vertical adjustment;

fastening means for securing said wing tab to said second boss of each end tank;

whereby said condenser is easily positioned and secured by the combination of said slip mount and said fastening means.

3. An assembly for securing a condenser to plastic end tanks of a radiator in a vehicle, comprising:

a first boss including fingers forming a receiving slot and secured to a first portion of each end tank;

a second boss secured to a second portion of each end tank;

said bosses including said fingers being integrally molded in said end tanks;

an elongated strip bracket attached to said condenser including a wing hook and a wing tab for mating with said first and second bosses, respectively;

said wing hook including a blade mating in sliding engagement in said slot between said fingers to form a slip mount to allow vertical adjustment;

said wing hook being L-shaped and depending along the side of said fingers to prevent side-to-side movement;

said fingers being resilient and the width of at least a portion of said slot being less than the thickness of said blade to provide compression engagement;

said fingers being tapered along said slot and the front finger being shorter for guiding said blade during insertion;

fastening means for securing said wing tab to said second boss of each end tank;

whereby said condenser is easily positioned and secured by the combination of said slip mount and said fastening means.

* * * * *